US005666628A

United States Patent [19]

Fukai

[11] Patent Number: 5,666,628

[45] Date of Patent: Sep. 9, 1997

[54] METHOD OF FIXING TONER APPLYING WET MEDIUM

[75] Inventor: Hisayo Fukai, Tokyo, Japan

[73] Assignees: Qyentos Corporation; Unico Co., Ltd., both of Osaka, Japan

[21] Appl. No.: 281,652

[22] Filed: Jul. 28, 1994

[30] Foreign Application Priority Data

Jul. 29, 1993 [JP] Japan ..... 5-187851

[51] Int. Cl.[6] ..... G03G 15/20

[52] U.S. Cl. ..... 399/340

[58] Field of Search ..... 355/282, 285, 355/293; 219/216, 469, 471; 430/97, 124; 427/421, 430.1; 118/300, 302, 400; 399/320, 340

[56] References Cited

U.S. PATENT DOCUMENTS

| | | | |
|---|---|---|---|
| 4,908,669 | 3/1990 | Yamamoto | 355/282 |
| 5,045,888 | 9/1991 | Imaeda | 355/282 |
| 5,426,491 | 6/1995 | Landa et al. | 355/256 |

FOREIGN PATENT DOCUMENTS

| | | | |
|---|---|---|---|
| 0033792 | 9/1974 | Japan | 355/293 |
| 0118139 | 10/1978 | Japan | 355/293 |
| 57-135966 | 8/1982 | Japan . | |
| 0261289 | 10/1988 | Japan | 355/293 |
| 5221119 | 8/1993 | Japan | 355/293 |

*Primary Examiner*—William J. Royer
*Attorney, Agent, or Firm*—Wenderoth, Lind & Ponack

[57] ABSTRACT

Method of fixing toner by applying a fixing agent to a substrate containing an unfused toner at predetermined positions thereof, by spraying or dripping the fixing agent onto the substrate, or immersing the back surface of the substrate into the fixing agent to permit the fixing agent to permeate into the other side of the substrate containing the toner. The fixing agent causes the unfused toner to be half-dissolved or swollen on the surface of the object and the half-dissolved or swollen toner is dried to be fixed to the substrate.

14 Claims, 4 Drawing Sheets

METHOD OF FIXING TONER APPLYING WET MEDIUM

BACKGROUND OF THE INVENTION

The present invention relates to an improved method of fixing a toner by applying a wet medium.

Conventionally, there are a variety of practical methods for fixing an unfused toner on a paper surface after being transferred thereto from a photoconductor of a dry electronic copier or a laser printer, for example, including the following:

1. Thermal fixing methods:

[1] A thermoconductive method for fusing and fixing an unfused toner with a heated roller;

[2] A radiation method for fusing and fixing an unfused toner by radiating infra-red rays or flash;

[3] A convection method for fusing and fixing an unfused toner via a heat treatment in an electric oven;

[4] A high-frequency thermal method for fusing and fixing an unfused toner by heating the water content of a medium and objective paper in an electronic microwave oven;

2. A pressure fixing method for fusing and fixing an unfused toner by applying pressure generated by a high-pressure roller;

3. A wet fixing method for fusing and fixing an unfused toner by dissolving a thermoplastic resin (being a constituent of toner) with a solvent via a solvent atmosphere.

However, the above conventional fixing methods respectively have a variety of technical problems described below.

When applying any of the thermal fixing methods, an unfused toner cannot properly be fixed onto all the objective surfaces except for those which are having specific sizes. Concretely, a proper heating means is essential to implement the thermal fixing method. However, because of technically difficult aspects, a large heating means cannot be applied. For instance, whenever drawing an image on a large-sized paper such as the A1 or A0 class, the image must be drawn on the paper surface directly with ink of a slow-moving pen-plotter.

On the other hand, since the above-cited pressure fixing method necessarily applies such a high pressure being more than scores of kilogram per square centimeter, the operator is obliged to introduce large-sized equipment and a soft-and-expensive resin such as a polyethylene resin or a polypropylene resin composing the toner, thus incurring a processing cost which is too expensive.

On the other hand, preceding Japanese Laid-Open Patent Application Publication No. SHO57-135966 (1982) corresponding to German Patent Application No. P3048477.6 discloses a method of fixing a toner using a wet compound. Concretely, as shown in FIG. 7, according to this prior art, by initially passing a paper 101 bearing a transferred image of an unfused toner through a container 102 filled with vaporized solvent, the produced image is fixed on the paper surface 101 by dissolving the toner with a solvent. According to this method, a lesser amount of electric power is consumed for the toner fusing process to save energy cost. Nevertheless, since acetone or toluene are inflammable and toxic solvents, the use of such a toner poses safety problems. Furthermore, not only resinous components, but also anti-static agents, and pigments such as carbon black or dyestuffs, are also used in such toners. In consequence, when such a system for immersing a toner in a solvent such as acetone or toluene is introduced, the solvent may dissolve the image on the paper surface, causing it to run, thus restraining the effective scope of the available toner components.

OBJECT AND SUMMARY OF THE INVENTION

The objects of the invention is to fully solve the above problems by providing an improved method of fixing an unfused toner onto the objective surface of any size, including a large-size surface by applying a wet medium at inexpensive cost without endangering environmental safety, thus securely fixing a clear image from the preceding transfer process.

To achieve the above object, according to the first inventive method of fixing unfused toner by applying a wet medium, the objective surface accommodating the unfused toner at predetermined positions is initially treated with sprayed or dripped fixing agent before eventually drying it.

According to the second inventive method of fixing an unfused toner by applying a wet medium, an objective accommodating unfused toner at predetermined positions is initially immersed in a fixing agent before eventually drying it.

According to the third inventive method of fixing an unfused toner by applying a wet medium, the reverse surface of an objective surface accommodating an unfused toner at predetermined positions is impregnated with a fixing agent until the fixing agent reaches the toner before drying the paper with the toner fixed thereupon.

When implementing any of the first through third inventive methods, the unfused toner is not fully dissolved on the surface of the first objective, but instead the unfused toner is once incompletely dissolved or swollen thereon. Next, the half-dissolved or swollen toner surface is pressed against the surface of second objective to cause the half-dissolved or swollen toner to be transferred onto the second objective before eventually drying the second objective.

Fixing agents available for implementing the first through third inventive methods includes fixing agents containing organic compounds capable of half-dissolving or swelling the toner and which are insoluble or hardly soluble to water and fixing agents containing organic compounds capable of half-dissolving or swelling the toner, wherein the organic compounds are dispersed and mixed in such organic compounds which are incapable of dissolving or swelling the toner.

Next, the functional operation of the invention is described below.

According to the first inventive method, organic compounds contained in fixing agents sprayed or dripped onto the surface of a surface such as paper does not fully dissolve the resinous component contained the unfused toner at first, but instead, the organic compounds transmute the resinous component into a half-dissolved or swollen condition (hereafter merely called a gummy condition) to cause the toner to closely adhere to surface of the objective surface.

According to the second inventive method, subsequent to immersion of an objective surface accommodating an unfused toner in a fixing-agent solution, the organic compound contained in the fixing-agent solution transmutes the resinous component in the unfused toner into a gummy condition to facilitate close adherence of toner surface. Finally, after fully drying the toner-coated objective, the toner is firmly fixed on the surface thereof.

According to the third inventive method, initially, an objective paper superficially accommodating an unfused toner is impregnated with a fixing-agent solution from the back surface thereof. Next, by causing the fixing agent to act upon the back surface of an unfused toner, an organic compound in the fixing agent changes the resinous component contained in the unfused toner into a gummy condition in order that the toner can closely adhere to the objective paper surface. After fully drying the surface, the toner is solidly fixed on the objective surface.

More particularly, when implementing any of the first through third inventive methods, dispersed mixing of water with such an organic compound totally insoluble or hardly soluble to water or dispersed mixing of such an organic compound capable of half-dissolving or swelling toner with such an organic compound incapable of dissolving or swelling toner merely results in transmutation of the resinous component of toner into a gummy condition without fully dissolving the resinous component by applying such a fixing agent capable of suppressing the solubility of the organic compounds. In consequence, the toner is solidly fixed on the objective surface to generate a clear-cut image. Furthermore, since the unfused toner is once transmuted into a gummy condition by applying a fixing agent before securely being fixed on the objective surface, the toner can easily be fixed without necessarily using a large sized thermal roller.

According to another method, in the same way as was done for the first through third inventive methods, the unfused toner is once transmuted into a gummy condition on the first objective surface, and then the second objective surface is superposed on the gummy toner. Next, the superposed second objective surface is pressurized to cause the gummy toner of the inverted image to be transferred onto the the second objective surface. After fully drying the second objective surface, the toner is firmly fixed on the surface of the second objective.

The above and further objects and novel features of the invention will more fully be apparent from the following detailed description given in reference to the accompanying drawings which are shown below merely by way of example.

DETAILED DESCRIPTION OF THE PREFERRED EMBODIMENTS

Referring now to the accompanying drawings representing preferable embodiments, the method of fixing a toner by applying a wet medium according to the invention is described below.

Figure 1A:
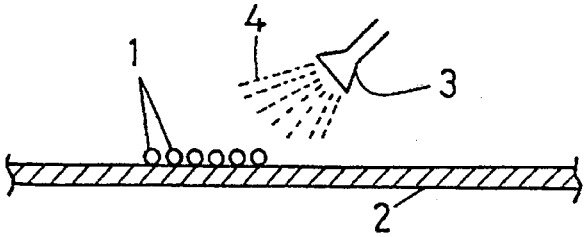
FIGS. 1A and 1B schematically illustrate the first embodiment of the method of fixing toner by applying a wet medium according to the invention.

First Embodiment:

As shown in FIG. 1A, using a sprayer 3, a fixing agent 4 (based on formulary 9 shown later on) was initially sprayed onto the surface of an objective paper 2 accommodating an unfused toner 1 in an amount sufficient to prevent the unfused toner 4 from irregularly being stirred.

Figure 1B:
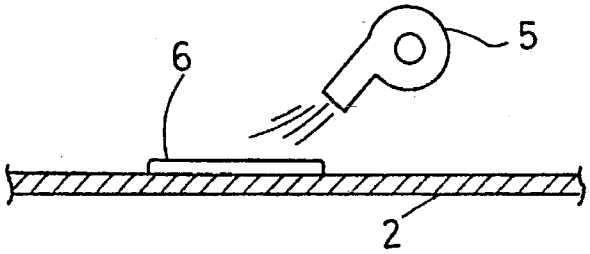

As shown in FIG. 1B, after several seconds were past, the treated paper surface 2 was fully dried by blowing air via a blower 5.

After completing the drying process, it was visually confirmed that toner 6 was fully fixed on the paper surface 2 without any blurring of the produced image.

Figure 2A:
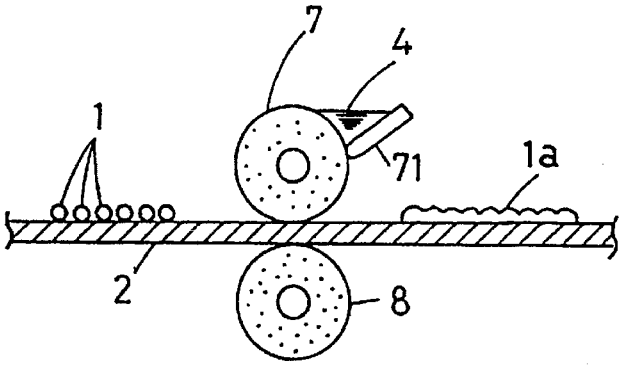
FIGS. 2A and 2B schematically illustrate the second embodiment of the method of fixing toner by applying a wet medium according to the invention.
Figure 2B:
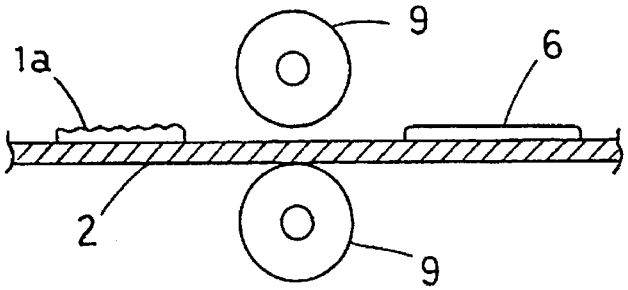

Second Embodiment:

As shown in FIG. 2A, initially, an objective paper 2 accommodating an unfused toner 1 was conveyed through a"TEFLON"-coated non-adhesive sponge roller 7 and a receptive roller 8 and then damped with fixing agent 4 (based on formulary 1 shown later on) impregnated in the sponge roller 7. Next, after half-dissolving or swelling the resinous component in the unfused toner 1, the resinous component was closely fixed on the objective paper surface 2. Finally, as shown in FIG. 2B, the paper 2 superficially adhered with gummy toner 1*a* was conveyed through a pair of thermal rollers 9 and 9 before fully being dried.

After completing the drying process, it was visually confirmed that toner 6 was fully fixed on the paper surface 2 without incurring any blurring of the produced image at all.

In FIG. 2A, the numeral 71 indicates a blade.

Figure 3A:
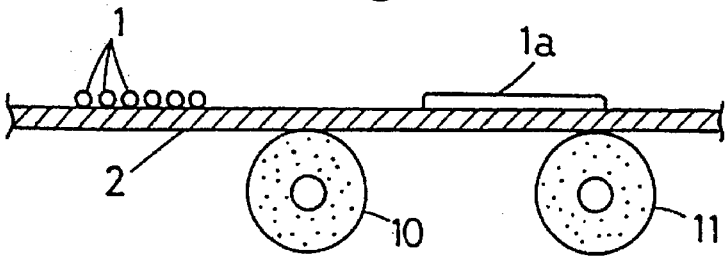
FIGS. 3A and 3B schematically illustrate the third embodiment of the method of fixing toner by applying a wet medium according to the invention.
Figure 3B:
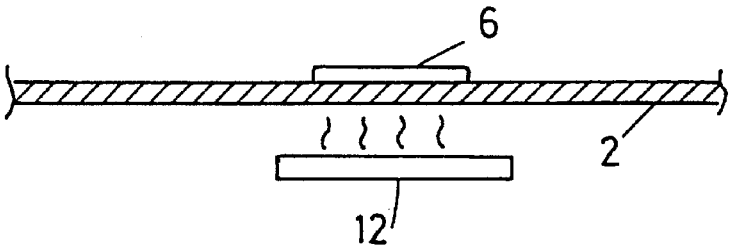

Third Embodiment:

As shown in FIG. 3A, a sponge roller 10 impregnated with fixing agent 4 (based on formulary 2 shown later on) was pressed against the back surface of an objective paper 2 superficially accommodating unfused toner 1 to fully impregnate the paper 2 with the fixing agent 4. Next, the unfused toner 1 on the paper surface was damped with the fixing agent 4, and then, after swelling the resinous component contained in the unfused toner 1, the swollen resinous component was closely fixed on the paper surface 2. Finally, as shown in FIG. 3B, the treated paper 2 was fully dried by pressing a heated plate 12 against the back surface of the treated paper 2.

After completing the drying process, it was visually confirmed that toner 6 was fully fixed on the paper surface 2 without incurring any blurring of the produced image.

The reference numeral 11 shown in FIG. 3A designates a sucking roller that fully absorbs any surplus of the fixing agent 4.

Figure 4A:
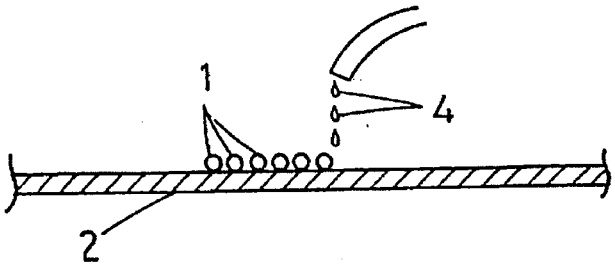
FIGS. 4A and 4B schematically illustrate the fourth embodiment of the method of fixing toner by applying a wet medium according to the invention.
Figure 4B:
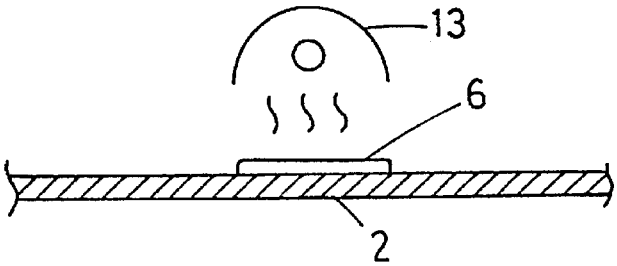

Fourth Embodiment:

As shown in FIG. 4A, fixing agent 4 (based on formulary 4 shown later on) was dripped onto unfused toner 1 previously disposed on surface of an objective paper 2. As shown in FIG. 4B, after several seconds were past, the treated paper 2 was dried in an oven 13.

After completing the drying process, it was visually confirmed that toner 6 was fully fixed on the paper surface 2 without incurring blurred symptom to the produced image at all.

Figure 5A:
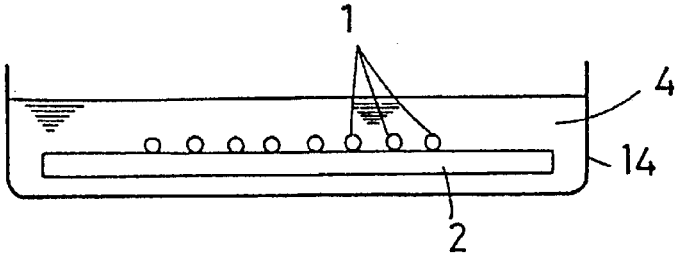
FIGS. 5A and 5B schematically illustrate the fifth embodiment of the method of fixing toner by applying wet medium according to the invention.
Figure 5B:
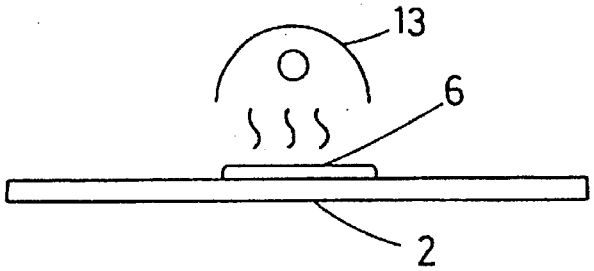

Fifth Embodiment:

As shown in FIG. 5A, initially, an objective paper 2 superficialy accommodating an unfused toner 1 was immersed in a container 14 containing a fixing solution 4 (based on formulary 9 shown later on). Then, after several seconds were past, the treated paper 2 was drawn out of the container 14, and finally, as shown in FIG. 5B, the treated paper 2 was fully dried in an oven 13.

After completing the drying process, it was visually confirmed that toner 6 was fully fixed on the paper surface 2 without incurring any blurring of the produced image.

Figure 6A:
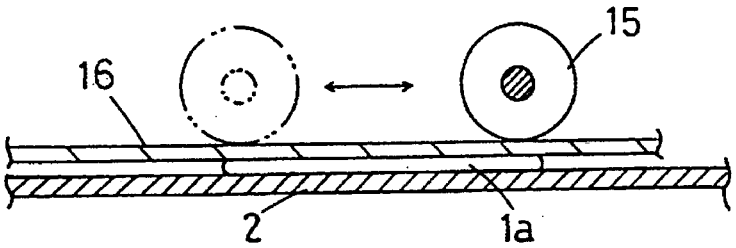
FIGS. 6A and 6B schematically illustrate the sixth embodiment of the method of fixing toner by applying a wet medium according to the invention.
Figure 6B:
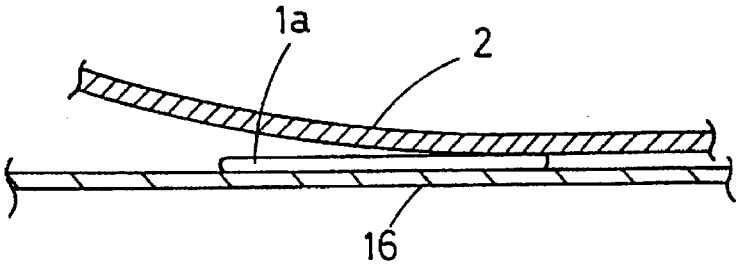
Figure 7:
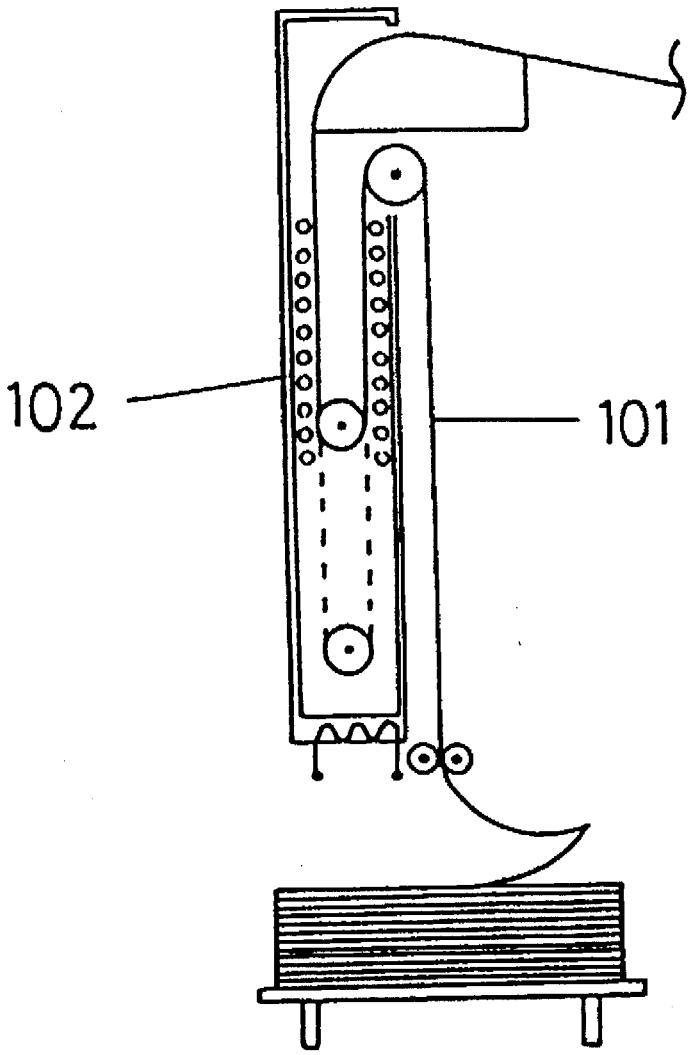
Prior Art Fig.7
FIG. 7 is a sectional view of a conventional device for executing a conventional method of fixing toner by applying a wet medium.

Sixth Embodiment:

As was done for the first embodiment, initially, using fixing solution 4, an unfused toner 1 was converted into a gummy condition, and then, the gummy toner was almost closely fixed on a paper 2 serving as the first object. Next, as shown in FIG. 6A, the second objective paper 16 was pressed against the gummy toner 1*a* before being pressed by a pressing roller 15. As shown in FIG. 6B, the first objective paper 2 was then stripped off. As a result, toner 1*a* was transferred onto the surface of the second objective paper 16 in the inverted condition. Then, as shown in FIG. 1B, the second objective paper 16 was dried by blowing air from a blower 5.

After completing the drying process, it was virtually confirmed that toner 6 was fully fixed on the image inverted onto the second objective paper 16 without causing the image to blur.

It should be understood however that the practical method of fixing toner onto on an objective paper via application of wet medium according to the invention is not solely restricted to those embodiments exemplified above. For example, when implementing the third embodiment, the fixing-agent solution 4 immersedly permeates into the paper 2 from the back surface by pressing the sponge 10 against the back surface of the paper 2. In place of the pressing method, solution of the fixing agent 4 may also be sprayed against the back surface of the paper 2.

When implementing the above embodiments, a thermal drying process was solely applied. However, an air drying process, a decompressed drying process or a conventional drying process under normal temperatures may also be applied.

When implementing the sixth embodiment, a paper served as the other object of fixing toner. However, toner may also be transferred onto a wall surface for example.

There is no limit in the nature of the organic compounds employed nor in the nature of the organic solvents capable of half-dissolving or swelling toner and yet which are insoluble or hardly soluble in water. In order to prepare a toner for implementing the fixing method related to the invention, there is at least one kind of compound selected from organic ester compounds, organic hydrocarbon compounds, fatty-acid compounds, organic ketone compounds, halogenated hydrocarbon compounds, aldehyde compounds, ether compounds, heterocyclic compounds, alcoholic compounds, organic nitrogen compounds, and at least one selected from a group comprising derivatives of any of the above-exemplified compounds. Any of the above-exemplified organic compounds may not necessarily be in liquified form. For example, a solid organic compound may be mixed with water as of the state being dissolved by any organic solvent.

In terms of an organic ester compound, any of those which are exemplified below may be selected, for treating toners with the method related to the invention, for example, including aliphatic ester compounds, such as ethyl acetate, ethyl oleate, ethyl acrylate, ethyl methacrylate, dibutyl succinate, dimethyl adipate, diethyl adipate, dimethyl succinate, diethyl succinate, dimethyl glutarate, diethyl glutarate, diethyl phthalate, dibutyl phthalate, diethyl tartarate, butyl palmitate, dioctyl phthalate, ethyl α-aminoate, or ethyl L-glutarate, and derivatives from the above aliphatic ester compounds; those aromatic ester compounds such as methyl benzoate or triphenyl phosphate and derivatives from these aromatic ester compounds, heterocyclic ester compounds such as methyl isonicotinate and derivatives thereof; and coal oxide, etc.

In terms of organic hydrocarbon compounds, any of those which are exemplified below may be used for treating toners with the method related to the invention, for example, kerosene, fluid paraffine, heptane, benzene, toluene, or cyclohexane, etc.

In terms of halogenated hydrocarbon compounds, 1,1,1-trichloroethane or a α-chloronaphthalene may be used for implementing the method of fixing toners related to the invention.

In terms of alcoholic compounds, the following may be used for treating toners related to the invention i.e., methanol, ethanol, n-octyl alcohol, n-decyl alcohol, diethylene glycol, glycerine, polyethylene glycohol, methyl cellosolve, tertiary amil-alcohol, phenol, benzyl alcohol, or methyl benzyl alcohol, etc.

In terms of aliphatic compounds for treating toners with the method according to the invention, for example, acetic acid, benzoic acid, alkenic succinic acid, naphthenic acid, oleic acid, or isononanic acid, etc. may be used.

In terms of ketone compounds, acetone, methylethyl ketone, or methylisobutyl ketone, may be sued for treating toner with the method related to the invention.

In terms of aldehyde compounds, acetoaldehyde or benzaldehyde may be used for treating toners with the method related to the invention.

In terms of ether compound, ethylether, diisopropylether, or octylphenylether may be used for treating toners with the method related to the invention.

In terms of organic nitrogen compounds, N,N-dimethylformaldehyde, diethylamine, aniline, or dichlorohexylamine, may be used for treating toners with the method related to the invention.

In terms of heterocyclic compounds, N-methyl-2-pyrolidone may be used for treating toners with the method related to the invention.

Any kind of water such as pure water, distilled water, conventional tap-water, or river water, may be used.

There is not specific restriction of the blend ratio between the above-exemplified organic compound and water. However, it is desired that 1 through 90% by weight of selected organic compounds be contained in the fixing-agent solution against water. Preferably, the blend ratio shall remain in a range expressed by a formula shown below:

$$\alpha+10/(100-\beta)-10 \text{ through } (100-\beta)/\beta+10$$

where α designates limit (% by weight of the solubility of organic compound against water, whereas β designates the limit (% by weight) of solubility of water against the organic compound.

In addition to any of those organic compounds exemplified above and water, available fixing agents may also contain any of the following surface active agents: higher aliphatic-acid metal salts such as sodium laurate or sodium oleate, anionic surface active agents such as sodium alkylbenzenesulphonate, higher alcohol (sodium lauryl sulfate, sodium cetyl sulfate, or sodium stearyl sulfate, for example); cationic surface active agents falling under quaternary ammonium salts or amine salts, and those nonionic surface active agents including alkylene-oxide (ethylene oxide or propylene oxide)- added type nonionic surface active agents, such as higher alcohol (lauryl alcohol, cetyl alcohol, palm-oil reduced alcohol, oleic alcohol), alkyl (octic, nonyl, or dodecyl) phenol, or aliphatic acid (stearic acid or oleic acid), or those nonionic surface active agents falling under polyhydric alcohol esters such as sorbitol or sugar ester, for example.

Normally, it is desired that 1 part or more than 1 part by weight of any of those usable surface active agents be added against 100 parts by weight of the blend of organic compound and water. Although the practical effect of fixing a toner, based on the inventive method, can be achieved even when no surfactant is added to the fixing-agent solution, it is essential that selected organic compounds be properly mixed with water before starting off the toner fixing process by sufficiently vibrating and stirring the blend solution.

When implementing the inventive method by formulating usable fixing-agent solutions, it is suggested to properly blend an optimum amount of selected surfactant with a predetermined amount of mixed solution of selected organic compound and water, if deemed necessary.

It is suggested that a selected assisting agent conventionally called a "coupling agent" may also be added to the toner-fixing agent, for example, including the following; cellosolves, such as diethylene glycol, triethylene glycol, polyethylene glycol, monobutyl ether, diethylene glycol monomethylether, and diethylene glycol monobutylether, or N- methyl-2-pryolidone, or the like. When using any of those assisting agents, the dispersibility of the organic compound is promoted, thus eventually improving the toner-fixation effect and simultaneously saving consumption of the surface active agent as well.

No restriction applies to the toner fixing agent in which such an organic compound capable of dissolving or swelling a toner is dispersedly mixed in another organic compound incapable of dissolving or swelling the toner. Regarding the organic compound capable of dissolving or swelling a toner, it is suggested that a dibasic carbonic acid diester be used. In respect to the other organic compound incapable of dissolving or swelling the toner, propylene carbonate is suggested.

No restriction applies to formulations of a fixing agent in the present invention but the following formulations are suggested.

| Formulary 1 | |
|---|---|
| heptane | 18 wt % |
| glycol ether | 10 wt % |
| sulfosuccinate-type surfactant (Sulfosuccinate is purchased from San Napco Ltd.) | 7 wt % |
| water | 65 wt % |

| Formulary 2 | |
|---|---|
| benzene | 5 wt % |
| organate ester sulfation | 7 wt % |
| glycol ether | 5 wt % |
| water | 88 wt % |

| Formulary 3 | |
|---|---|
| toluene | 8 wt % |
| organate ester sulfation | 9 wt % |
| propylene oxide ethylene oxide copolymer | 4 wt % |
| water | 79 wt % |

| Formulary 4 | |
|---|---|
| benzyl alcohol | 10 wt % |
| glycol ether | 10 wt % |
| sulfosuccinate-type surfactant | 10 wt % |
| water | 70 wt % |

| Formulary 5 | |
|---|---|
| methyl isobutyl ketone | 17 wt % |
| sulfosuccinate-type surfactant | 17 wt % |
| water | 66 wt % |

| Formulary 6 | |
|---|---|
| diisopropyl ether | 12 wt % |
| organate ester sulfation | 10 wt % |
| water | 78 wt % |

-continued

| Formulary 7 | |
|---|---|
| aniline | 65 wt % |
| glycol ether | 7 wt % |
| sulfosuccinate-type surfactant | 7 wt % |
| water | 71 wt % |

| Formulary 8 | |
|---|---|
| 1,1,1-trichloro ethane | 10 wt % |
| glycol ether | 10 wt % |
| organate ester sulfation | 10 wt % |
| water | 70 wt % |

| Formulary 9 | |
|---|---|
| dibasic carboxylic diester (dimethyl adipate 17 wt %, dimethyl glutarate 66 wt %, dimethyl succinate 17 wt %) | 15 wt % |
| 3-methyl-3-methoxybutanol | 15 wt % |
| organate ester sulfation | 9 wt % |
| propylene oxide ethylene oxide copolymer | 2 wt % |
| polyoxyethylene alkylphenyl ether | 2 wt % |
| water | 57 wt % |

| Formulary 10 | |
|---|---|
| dibasic carboxylic diester (dimethyl adipate 17 wt %, dimethyl glutarate 66 wt %, dimethyl succinate 17 wt %) | 15 wt % |
| 3-methyl-3-methoxybutanol | 25 wt % |
| water | 60 wt % |

| Formulary 11 | |
|---|---|
| dibasic carboxylic diester (dimethyl adipate 17 wt %, dimethyl glutarate 66 wt %, dimethyl succinate 17 wt %) | 8 wt % |
| N methyl-2-pyrrolidone | 10 wt % |
| isopropyl alcohol | 8 wt % |
| water | 74 wt % |

| Formulary 12 | |
|---|---|
| dibasic carboxylic diester (dimethyl adipate 17 wt %, dimethyl glutarate 66 wt %, dimethyl succinate 17 wt %) | 8 wt % |
| sodium sulfate of butyl oleate | 15 wt % |
| diethanol amido oleate | 15 wt % |
| water | 7 wt % |
| | 63 wt % |

| Formulary 13 | |
|---|---|
| heptane | 25 wt % |
| 3 methyl-3 methoxybutanol | 20 wt % |
| isopropyl alcohol | 10 wt % |
| water | 45 wt % |

| Formulary 14 | |
|---|---|
| heptane | 15 wt % |
| 3 methyl-3 methoxybutanol | 15 wt % |
| N methyl-2-pyrrolidone | 5 wt % |
| sodium sulfate of butyl oleate | 9 wt % |
| polyoxy alkylene monoalkyl ether | 2 wt % |
| water | 54 wt % |

| Formulary 15 | |
|---|---|
| ethyl acetate | 17 wt % |
| 3 methyl-3 methoxybutanol | 20 wt % |
| sodium sulfate of butyl oleate | 7 wt % |
| polyoxy alkylene monoalkyl ether | 2 wt % |
| water | 54 wt % |

| Formulary 16 | |
|---|---|
| ethyl oleate | 20 wt % |
| isopropyl alcohol | 7 wt % |
| 3 methyl-3 methoxybutanol | 15 wt % |
| sodium sulfate of butyl oleate | 9 wt % |
| polyoxy alkylene monoalkyl ether | 2 wt % |
| water | 47 wt % |

| Formulary 17 | |
|---|---|
| ethyl α-aminate | 15 wt % |
| 3 methyl-3 methoxybutanol | 15 wt % |
| sodium sulfate of butyl oleate | 9 wt % |
| polyoxy alkylene monoalkyl ether | 2 wt % |
| polyoxyethylene alkylphenyl ether | 2 wt % |
| water | 57 wt % |

-continued

Formulary 18

| | |
|---|---|
| benzyl alcohol | 20 wt % |
| 3 methyl-3 methoxybutanol | 15 wt % |
| N methyl-2-pyrrolidone | 5 wt % |
| sodium sulfate of butyl oleate | 10 wt % |
| polyoxy alkylene monoalkyl ether | 2 wt % |
| water | 48 wt % |

Formulary 19

| | |
|---|---|
| methylbenzyl alcohol | 30 wt % |
| 3 methyl-3 methoxybutanol | 15 wt % |
| isopropyl alcohol | 15 wt % |
| water | 40 wt % |

Formulary 20

| | |
|---|---|
| dimethyl succinate | 15 wt % |
| 3 methyl-3 methoxybutanol | 15 wt % |
| sodium sulfate of butyl oleate | 9 wt % |
| polyoxy alkylene monoalkyl ether | 2 wt % |
| polyoxyethylene alkylphenyl ether | 2 wt % |
| water | 57 wt % |

Formulary 21

| | |
|---|---|
| dimethyl succinate | 8 wt % |
| diethyl succinate | 7 wt % |
| N methyl-2-pyrrolidone | 20 wt % |
| sodium sulfate of butyl oleate | 9 wt % |
| polyoxy alkylene monoalkyl ether | 2 wt % |
| polyoxyethylene alkylphenyl ether | 2 wt % |
| water | 52 wt % |

Formulary 22

| | |
|---|---|
| dimethyl glutarate | 20 wt % |
| 3 methyl-3 methoxybutanol | 20 wt % |
| N methyl-2-pyrrolidone | 5 wt % |
| sodium sulfate of butyl oleate | 9 wt % |
| polyoxy alkylene monoalkyl ether | 2 wt % |
| polyoxyethylene alkylphenyl ether | 1 wt % |
| water | 43 wt % |

Formulary 23

| | |
|---|---|
| dimethyl succinate | 5 wt % |
| diethyl succinate | 3 wt % |
| 3 methyl-3 methoxybutanol | 10 wt % |
| sodium sulfate of butyl oleate | 8 wt % |
| polyoxy alkylene monoalkyl ether | 2 wt % |
| polyoxyethylene alkylphenyl ether | 1 wt % |
| water | 72 wt % |

Formulary 24

| | |
|---|---|
| dibutyl phthalate | 9 wt % |
| 3 methyl-3 methoxybutanol | 20 wt % |
| N methyl-2-pyrrolidone | 10 wt % |
| sodium sulfate of butyl oleate | 7 wt % |
| water | 54 wt % |

Formulary 25

| | |
|---|---|
| diethyl tartarate | 12 wt % |
| 3 methyl-3 methoxybutanol | 15 wt % |
| sodium sulfate of butyl oleate | 9 wt % |
| polyoxy alkylene monoalkyl ether | 2 wt % |
| polyoxyethylene alkylphenyl ether | 2 wt % |
| water | 60 wt % |

Formulary 26

| | |
|---|---|
| benzoic acid | 17 wt % |
| 3 methyl-3 methoxybutanol | 15 wt % |
| isopropyl alcohol | 10 wt % |
| water | 58 wt % |

Formulary 27

| | |
|---|---|
| benzoic acid | 25 wt % |
| 3 methyl-3 methoxybutanol | 20 wt % |
| N methyl-2-pyrrolidone | 5 wt % |
| sodium sulfate of butyl oleate | 10 wt % |
| polyoxy alkylene monoalkyl ether | 2 wt % |
| water | 38 wt % |

-continued

Formulary 28

| | |
|---|---|
| methylisobutyl ketone | 17 wt % |
| 3 methyl-3 methoxybutanol | 20 wt % |
| sodium sulfate of butyl oleate | 8 wt % |
| polyoxy alkylene monoalkyl ether | 2 wt % |
| water | 53 wt % |

Formulary 29

| | |
|---|---|
| diisopropyl ether | 12 wt % |
| diethanol amido oleate | 28 wt % |
| N methyl-2-pyrrolidone | 10 wt % |
| water | 66 wt % |

Formulary 30

| | |
|---|---|
| tea tree oil | 13 wt % |
| 3 methyl-3 methoxybutanol | 15 wt % |
| sodium sulfate of butyl oleate | 9 wt % |
| polyoxy alkylene monoalkyl ether | 2 wt % |
| polyoxyethylene alkylphenyl ether | 2 wt % |
| water | 59 wt % |

Fixing agents in the above formularies 1–30 are preferable to be oil in water type although water in oil type is also usable.

Formulary A

| | |
|---|---|
| dibasic carboxylic diester (dimethyl adipate 17 wt %, dimethyl glutarate 66 wt %, dimethyl succinate 17 wt %) | 20 wt % |
| propylene carbonate | 80 wt % |

Formulary B

| | |
|---|---|
| dibasic carboxylic diester (dimethyl adipate 17 wt %, dimethyl glutarate 66 wt % dimethyl succinate 17 wt %) | 30 wt % |
| propylene carbonate | 70 wt % |

Formulary C

| | |
|---|---|
| dibasic carboxylic diester (dimethyl adipate 17 wt %, dimethyl glutarate 66 wt %, dimethyl succinate 17 wt %) | 40 wt % |
| propylene carbonate | 60 wt % |

Formulary D

| | |
|---|---|
| dibasic carboxylic diester (dimethyl adipate 17 wt %, dimethyl glutarate 66 wt %, dimethyl succinate 17 wt %) | 60 wt % |
| propylene carbonate | 40 wt % |

Formulary E

| | |
|---|---|
| dibasic carboxylic diester (dimethyl adipate 17 wt %, dimethyl glutarate 66 wt %, dimethyl succinate 17 wt %) | 50 wt % |
| propylene carbonate | 40 wt % |
| sodium sulfate of butyl oleate | 10 wt % |

Formulary F

| | |
|---|---|
| dibasic-carboxylic diester (dimethyl adipate 17 wt %, dimethyl glutarate 66 wt %, dimethyl succinate 17 wt %) | 50 wt % |
| propylene carbonate | 40 wt % |
| 3 methyl-3 methoxybutanol | 10 wt % |

In terms of resin used for toner, it is suggested to employ polyethylene resin, polypropylene resin, polyacryl resin or polyester resin.

Further, wood, resin, ceramic or fabric may serve as an object of fixing toner, instead of paper.

What is claimed is:

1. A method of fixing a toner to an objective surface by applying a wet medium to the surface thereof comprising:

half-dissolving or swelling the toner by spraying or dripping a fixing agent on a first objective surface containing an unfused toner at a predetermined position, said fixing agent containing an organic compound capable of half-dissolving or swelling the toner and being insoluble or hardly soluble in water in a state in which it is mixed and dispersed in water;

pressing the half-dissolved or swollen toner on said first objective surface against a second objective surface to cause the half-dissolved or swollen toner to be transferred onto the second objective surface; and drying the second objective surface containing the fixing agent to affix the toner thereto.

2. A method of fixing a toner by applying the wet medium of claim 1, wherein:

the organic compound is at least one compound selected from the group consisting of an organic ester compound, an organic hydrocarbon compound, a fatty-acid compound, an organic ketone compound, a halogenated hydrocarbon compound, an aldehyde compound, an ether compound, a heterocyclic compound, an alcoholic compound, an organic nitrogen compound, and derivatives thereof.

3. A method of fixing a dry toner to a surface by applying a wet medium comprising:

half-dissolving or swelling a toner by immersing a first objective surface containing a toner in a fixing agent, said fixing agent containing an organic compound capable of half-dissolving or swelling the toner and being insoluble or hardly soluble in water when mixed and dispersed in water;

pressing the half-dissolved or swollen toner on said first objective surface against a second objective surface to cause the half-dissolved or swollen toner to be transferred onto the second objective surface; and drying the second objective surface to affix the toner to the surface thereof.

4. A method of fixing a toner by applying the wet medium of claim 3, wherein:

the organic compound is at least one compound selected from the group consisting of an organic ester compound, an organic hydrocarbon compound, a fatty-acid compound, an organic ketone compound, a halogenated hydrocarbon compound, an aldehyde compound, an ether compound, a heterocyclic compound, an alcoholic compound, an organic nitrogen compound, and derivatives thereof.

5. A method of fixing a dry toner to a surface by applying a wet medium comprising:

half-dissolving or swelling a toner by impregnating a fixing agent to a back surface of a substrate containing an unfused toner on the opposite side thereof at a predetermined position until the fixing agent permeates to the opposite side of the substrate and reaches the toner, said fixing agent containing an organic compound capable of half-dissolving or swelling the toner and being insoluble or hardly soluble in water when dispersed and mixed in water;

pressing the half-dissolved or swollen toner on said substrate against a second surface to cause the half-dissolved or swollen toner to be transferred onto the second surface; and drying the second surface to affix the toner thereto.

6. A method of fixing a dry toner to a surface by applying a wet medium comprising:

half-dissolving or swelling a toner by spraying or dripping a fixing agent on a first surface containing an unfused toner at a predetermined position thereof, said fixing agent containing an organic compound capable of half-dissolving or swelling the toner and an organic compound incapable of dissolving or swelling the toner in a state in which the former organic compound in said fixing agent is dispersed and mixed with the latter organic compound;

pressing the half-dissolved or swollen toner against a second surface to cause the half-dissolved or swollen toner to be transferred onto the second surface; and drying the second surface to affix the toner thereto.

7. A method of fixing a toner by applying the wet medium of claim 6 wherein:

the organic compound capable of half-dissolving or swelling the toner is a dibasic carboxylic diester and the organic compound incapable of dissolving or swelling the toner is propylene carbonate.

8. A method of fixing a toner by applying a wet medium comprising:

half-dissolving or swelling a toner by immersing a first surface containing a toner in a fixing agent, said fixing agent containing an organic compound capable of half-dissolving or swelling a toner and an organic compound incapable of dissolving or swelling a toner in a state in which the former organic compound in said fixing agent is dispersed and mixed with the latter organic compound;

pressing the half-dissolved or swollen toner from the first surface against a second surface to cause the half-dissolved or swollen toner to be transferred onto the second surface; and drying the second surface to affix the toner thereto.

9. A method of fixing a toner onto a surface by applying the wet medium of claim 8, wherein:

the organic compound capable of half-dissolving or swelling the toner is a dibasic carboxylic diester and the organic compound incapable of dissolving or swelling the toner is propylene carbonate.

10. A method of fixing a dry toner to a surface by applying a wet medium comprising:

half-dissolving or swelling a toner by impregnating a fixing agent to a back surface of a substrate containing an unfused toner to a predetermined position until the fixing agent permeates to the opposite side of the substrate and reaches the toner, said fixing agent containing an organic compound capable of half-dissolving or swelling the toner and an organic compound incapable of dissolving or swelling the toner in a state in which the former organic compound in said fixing agent is dispersed and mixed with the latter organic compound; and drying the surface containing the toner.

11. A method of fixing a toner by applying the wet medium of claim 10, further comprising:

after half-dissolving or swelling the toner against a second surface to cause the half-dissolved or swollen toner to be transferred onto the second surface; and drying the second surface to affix the toner to said second surface.

12. A method of fixing a dry toner to a surface by applying the wet medium of claim 10, wherein:

the organic compound capable of half-dissolving or swelling the toner is a dibasic carboxylic diester and the organic compound incapable of dissolving or swelling the toner is propylene carbonate.

13. A method of fixing a dry toner to a surface by applying the wet medium of claim 1, wherein:

the organic compound capable of half-dissolving or swelling the toner is a dibasic carboxylic diester and the organic compound incapable of dissolving or swelling the toner is propylene carbonate.

14. The method of claim 5 wherein said organic compound is at least one compound selected from the group consisting of an organic ester compound, an organic hydrocarbon compound, a fatty-acid compound, an organic ketone compound, a halogenated hydrocarbon compound, an aldehyde compound an ether compound, a heterocyclic compound, an alcoholic compound, an organic nitrogen compound, and derivatives thereof.

* * * * *